United States Patent [19]

Baty

[11] Patent Number: 5,032,066

[45] Date of Patent: Jul. 16, 1991

[54] CONTROL DEVICE FOR A FUEL INJECTION PUMP

[76] Inventor: Didier Baty, 59, rue de la République, 28110 Luce, France

[21] Appl. No.: 473,727

[22] Filed: Feb. 2, 1990

[30] Foreign Application Priority Data

Feb. 2, 1989 [FR] France ..... 89 01350

[51] Int. Cl.[5] ..... F04B 7/04; F02M 37/04

[52] U.S. Cl. ..... 417/499; 417/494; 123/496; 123/503

[58] Field of Search ..... 123/496, 503; 417/494, 417/499

[56] References Cited

U.S. PATENT DOCUMENTS

| | | | |
|---|---|---|---|
| 1,636,998 | 7/1927 | Junkers | 123/503 |
| 2,173,811 | 9/1939 | Bischof | 123/503 |
| 4,029,071 | 5/1977 | Saito | 123/496 |
| 4,163,634 | 8/1979 | Powers | 123/503 |
| 4,962,793 | 10/1990 | Perr | 123/496 |

*Primary Examiner*—Leonard E. Smith
*Assistant Examiner*—Peter Korytnyk
*Attorney, Agent, or Firm*—Kenyon & Kenyon

[57] ABSTRACT

A control device for a piston of a fuel injection pump actuated by a push rod and a cam, wherein the cam profile successively comprises: a slope which causes the piston to advance rapidly; a slope which causes the piston to return slowly until it covers a fuel supply port; a slope which causes the piston to return rapidly; a level stage; and, finally, a slope which causes the piston to continue the return stroke.

1 Claim, 2 Drawing Sheets

CONTROL DEVICE FOR A FUEL INJECTION PUMP

This invention relates to a control device for a fuel injection pump of an internal combustion engine, wherein the pump is equipped with a piston which reciprocates in a sleeve equipped with a fuel supply port, wherein the angular position of the piston determines the volume of fuel injected and wherein the device comprises a push rod which acts on the piston and a cam which interacts with the push rod.

In fuel injection pumps equipped with a control device of this type, erosion occurs through cavitation in the fuel during its admission into the compression chamber. This cavitation is due to significant variations in pressure and in flow which occur when the piston clears the fuel injection cutoff point during advance, and when the compression chamber is placed in communication with the low pressure supply source during piston return.

Various known devices, comprising specially shaped piston discharge grooves or pressure dampers incorporated in the supply circuit, are designed to eliminate variations due to fuel injection cutoff during the advance of the piston. However, there are no devices that provide for elimination of variations due to sudden recompression of the vapor phase which is produced during fuel aspiration in the course of piston return.

This invention proposes such a control device, which permits elimination of the variations by controlling the movement of the piston during the return stroke. This control is achieved by means of a cam profile defined by five distinct phases including a first known phase comprising a slope causing the piston to advance from bottom dead center to top dead center, during which the piston movement produces the fuel injection, a final known phase comprising a slope causing the piston to return to bottom dead center, wherein the final slope extends over 50 degrees to 70 degrees of rotation of the cam, and three intermediate phases according to the invention comprising, in sequence:

- a slope producing slow piston return until the fuel supply port of the pump is completely closed and extending over 10 to 110 degrees of rotation of the cam;
- a slope producing rapid piston return until the fuel supply port is partially uncovered to an extent ranging from 20 to 40 percent of the total section of said port, the slope extending over 15 to 30 degrees of rotation of the cam; and
- a slope limiting the piston velocity to zero or substantially zero and which extends over 110 to 220 degrees of rotation of the cam.

The invention shall be more fully explained in the description and by the drawings which are supplied as examples.

Figure 1:
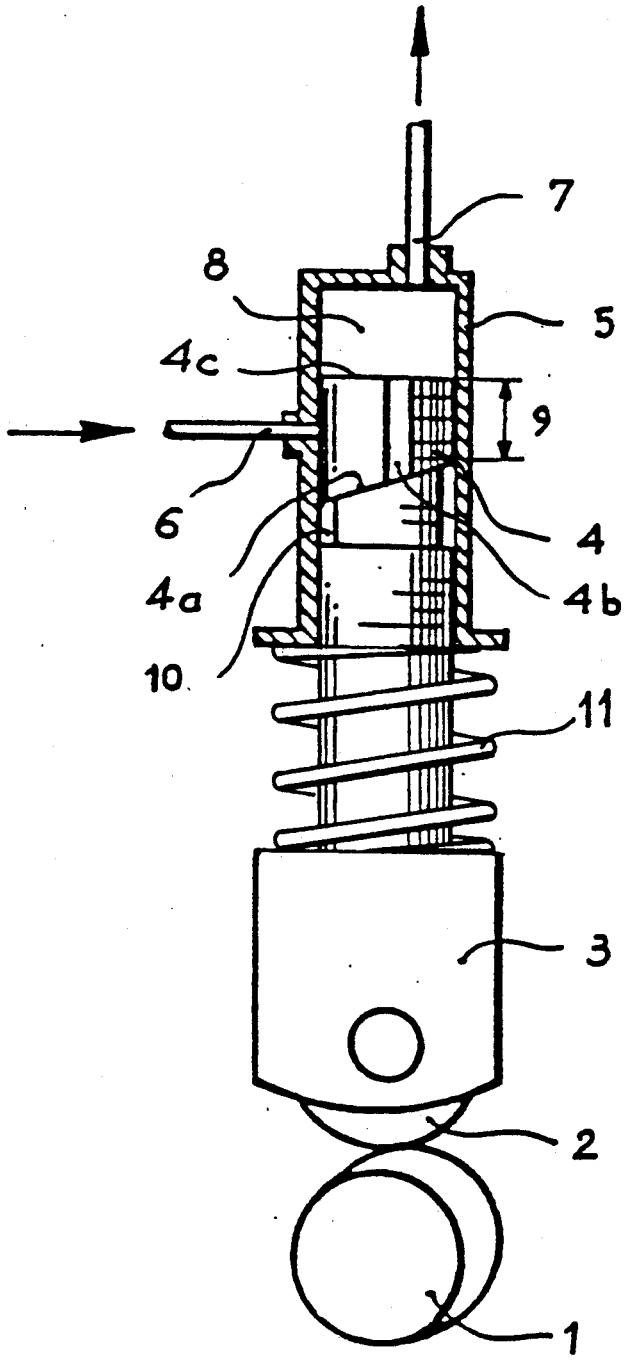
FIG. 1 is a schematic drawing of a fuel injection pump and its control device.

In FIG. 1, the pump comprises a piston 4 which slides within a sleeve 5 provided with a fuel supply port 6 which communicates with a low-pressure fuel source (not shown). The compression chamber 8 communicates with a fuel injection system (not shown) through a port 7. The piston 4 is angularly positioned by a device (not shown) in a manner such that a rear edge 4A determines the end of fuel injection as a function of the amount of fuel required. A groove 4B located on the piston communicates the compression chamber 8 with a space 10 located behind the rear edge 4A. Space 10, in turn, communicates with the fuel supply port 6 when edge 4A of the piston advances beyond the fuel intake port. This latter communication is interrupted during the portion of each stroke when the piston segment 9, between the limits of bottom edge 4A and top edge 4C, covers the fuel supply port 6.

The control device for this pump comprises a cam 1 and a push rod 3, the cam interacting with a follower 2 which is an integral part of the push rod.

This push rod is actuated by the cam against the return force of a spring 11 to drive the piston 4 of the pump.

Figure 2:
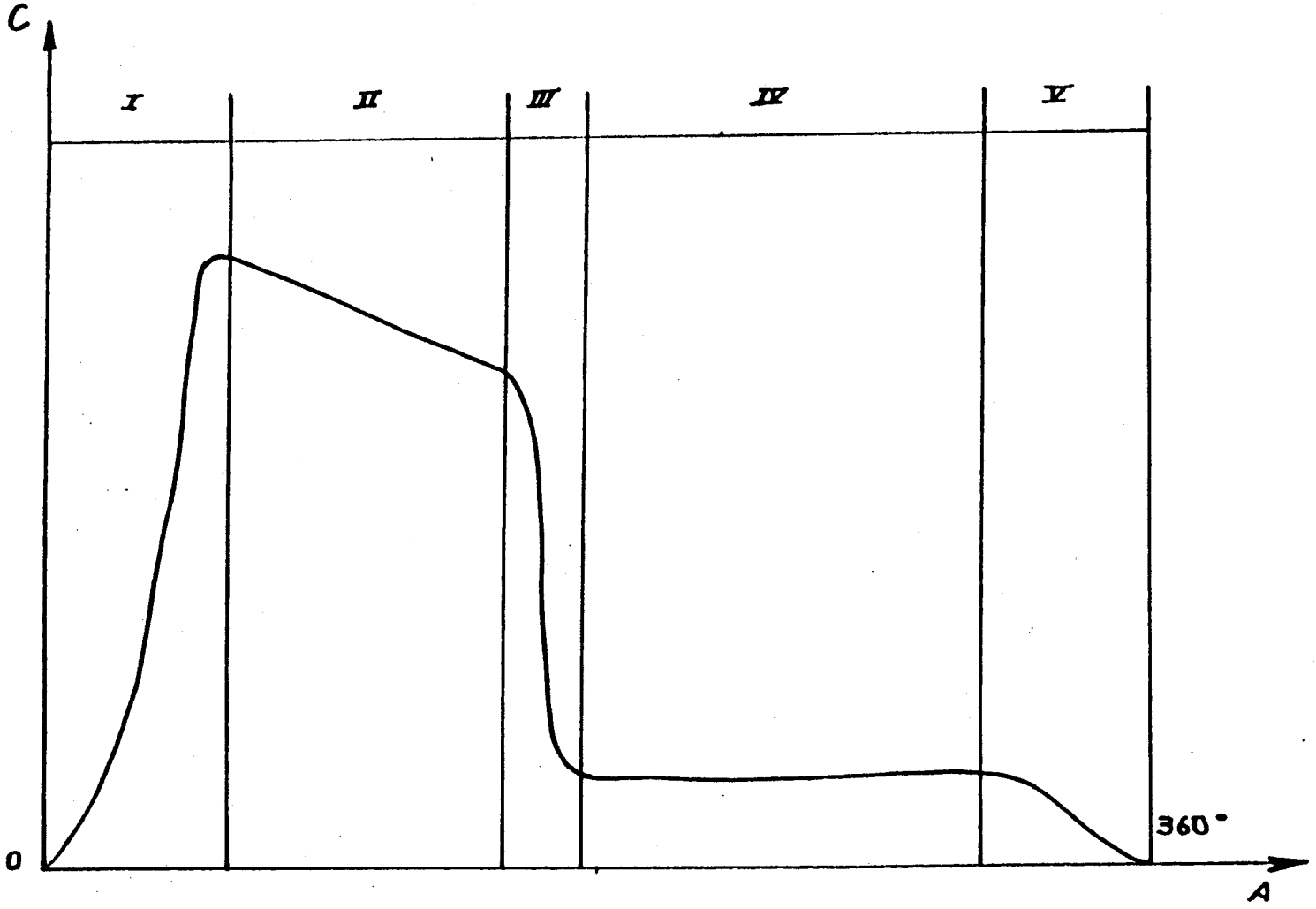
FIG. 2 is a diagram of the travel of the push rod of the control device.

FIG. 2 illustrates, along its abscissa, the angle of rotation A of the cam and, along its ordinate, the travel of push rod C.

The rotary motion of the cam is divided into five phases:

Phase I, advance of the piston from bottom dead center to top dead center, comprises the injection phase which is known.

Phases II to V, return of the piston from top dead center to bottom dead center, constitute the various stages of the compression chamber filling stroke.

During Phase II, the return movement of the piston controls the fuel intake into the compression chamber 8 through the fuel supply port 6, the space 10, and the groove 4B. If the return of the piston is not controlled, as proposed by the invention, the pressure loss resulting from the section of the passages and the flow imposed by the velocity of the piston is significant, and the volume of fuel contained in the compression chamber passes through a very low pressure which creates a vapor phase. Therefore, Phase II of this invention consists of sufficiently reducing the velocity of the piston 4 so as to prevent this vapor phase from occurring. Phase II is completed once the working part 9 of the piston has completely covered the fuel supply port 6. In FIG. 2, this Phase II extends over approximately 90 degrees, but it may extend over a range of 10 degrees to 110 degrees of rotation of the fuel injection cam.

During Phase III, the working part 9 of the piston 4 completely covers the fuel supply port 6. It is therefore impossible to avoid a significant pressure drop in the compression chamber 8 and therefore the appearance of a vapor phase.

Because this phenomenon is almost completely unrelated to the velocity of the piston 4, Phase III may be completed rapidly. Phase III ends when the edge 4C of the piston 4 uncovers the fuel supply port 6 to a value ranging from 20 to 40 percent of its total section. In FIG. 2, this Phase III extends over approximately 25 degrees, but it may extend over 15 degrees to 30 degrees of rotation of the fuel injection cam.

During Phase IV, the uncovering of the fuel supply port 6 is maintained at a value ranging from 20 to 40 percent of the total section, allowing only slow recompression of the fuel which returns from the vapor phase to the liquid phase. The slow rate of compression eliminates sudden variations in pressure and in flow, and thus prevents the appearance of cavitation erosion on the sleeve and on the piston. In FIG. 2, this Phase IV extends over approximately 120 degrees, but it may extend over 110 degrees to 220 degrees of rotation of the injection cam.

During Phase V, the piston 4 resumes its return to bottom dead center until it uncovers at least 75 percent of the section of the fuel supply port 6, so as to allow the compression chamber 8 to fill completely. In FIG. 2, this Phase V extends over approximately 60 degrees, but it may extend over 50 degrees to 70 degrees of rotation of the injection cam.

The cam is optimized for a given operating point of the engine, that is, for a predetermined volume of fuel injected. The greater the angle given to Phase II, the smaller the volume of injected fuel needed to reach the optimum point.

The magnitude of Phase IV is a function of the magnitude of Phase II. The greater the magnitude of Phase II, the smaller the magnitude of phase IV, and vice-versa, since the sum of the angle sectors occupied by the five phases must equal 360 degrees.

I claim:

1. A control device for a fuel injection pump of an internal combustion engine, the pump being equipped with a piston (4) which reciprocates within a sleeve (5) having a fuel supply port (6), the angular position of the piston determining the volume of fuel injected, and the device including a push rod (3) which actuates the piston and a cam (1) which interacts with the push rod, wherein the cam defines five distinct phases, a first phase composed of a slope causing the piston to advance from bottom dead center to top dead center, the fuel injection occurring during said advance, a final phase composed of a slope causing the piston to return to bottom dead center, the final slope extending over 50 degrees to 70 degrees of rotation of the cam, and three intermediate phases comprising in succession:

a slope causing the piston to return slowly until the fuel supply port (6) of the pump is completely closed and extending over 10 degrees to 110 degrees of rotation of the cam;

a slope causing the piston to return rapidly until the fuel supply port (6) is partially open to an extent ranging from 20 to 40 percent of the total section of said port, the slope extending over 15 to 30 degrees degrees of rotation of the cam; and a slope which immobilizes the piston during its return and which extends over 110 to 220 degrees of rotation of the cam.

* * * * *

UNITED STATES PATENT AND TRADEMARK OFFICE

CERTIFICATE OF CORRECTION

PATENT NO. : 5,032,066

DATED : July 16, 1991

INVENTOR(S) : Didier BATY

It is certified that error appears in the above-identified patent and that said Letters Patent is hereby corrected as shown below:

Cover Page, col. 2, line 4: change "4,962,793" to --4,962,743--.

Col. 4, line 18: after "15" insert --degrees--; after "30" delete "degrees".

Signed and Sealed this

Fifteenth Day of December, 1992

*Attest:*

DOUGLAS B. COMER

*Attesting Officer*

*Acting Commissioner of Patents and Trademarks*